US010412506B2

(12) United States Patent
Kim et al.

(10) Patent No.: US 10,412,506 B2
(45) Date of Patent: Sep. 10, 2019

(54) MICROPHONE AND MANUFACTURING METHOD THEREOF

(71) Applicants: Hyundai Motor Company, Seoul (KR); Kia Motors Corporation, Seoul (KR)

(72) Inventors: Hyunsoo Kim, Seoul (KR); Ilseon Yoo, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 32 days.

(21) Appl. No.: 15/804,083

(22) Filed: Nov. 6, 2017

(65) Prior Publication Data

US 2018/0332405 A1 Nov. 15, 2018

(30) Foreign Application Priority Data

May 11, 2017 (KR) ..... 10-2017-0058894

(51) Int. Cl.

| | |
|---|---|
| ***H04R 3/00*** | (2006.01) |
| ***H04R 19/04*** | (2006.01) |
| ***H04R 19/00*** | (2006.01) |
| ***H04R 1/04*** | (2006.01) |
| ***H04R 31/00*** | (2006.01) |
| ***H04R 7/14*** | (2006.01) |
| ***H04R 7/18*** | (2006.01) |

(52) U.S. Cl.

CPC ..... *H04R 19/04* (2013.01); *H04R 1/04* (2013.01); *H04R 3/007* (2013.01); *H04R 7/14* (2013.01); *H04R 7/18* (2013.01); *H04R 19/005* (2013.01); *H04R 31/00* (2013.01); *H04R 31/003* (2013.01)

(58) Field of Classification Search

CPC ..... H04R 3/00

See application file for complete search history.

(56) References Cited

U.S. PATENT DOCUMENTS

| | | | | |
|---|---|---|---|---|
| 4,651,120 | A * | 3/1987 | Aagard | G01L 9/0054 29/25.35 |
| 4,993,072 | A * | 2/1991 | Murphy | H04R 19/01 307/400 |
| 9,307,319 | B2 * | 4/2016 | Reimann | H04R 3/02 |
| 2006/0070449 | A1 * | 4/2006 | Yokoyama | G01L 9/0073 73/754 |

(Continued)

FOREIGN PATENT DOCUMENTS

| | | |
|---|---|---|
| EP | 2 535 310 A2 | 12/2012 |
| KR | 10-2001-0011918 | 2/2001 |

(Continued)

*Primary Examiner* — Olisa Anwah

(74) *Attorney, Agent, or Firm* — Mintz Levin Cohn Ferris Glovsky and Popeo, P.C.; Peter F. Corless

(57) ABSTRACT

A microphone and a manufacturing method thereof are provided. The microphone includes a substrate that has a cavity formed in a central portion thereof, and a diaphragm that is disposed on the substrate to cover the cavity and includes a first non-doped area formed at predetermined intervals. A fixed membrane is spaced apart from the diaphragm with an air layer interposed therebetween. A second non-doped area protrudes upward to prevent direct contact with the diaphragm and a supporting layer supports the fixed membrane and the diaphragm.

15 Claims, 13 Drawing Sheets

(56) References Cited

U.S. PATENT DOCUMENTS

| | | | | |
|---|---|---|---|---|
| 2012/0319217 | A1* | 12/2012 | Dehe | B81B 3/0072 257/415 |
| 2015/0060955 | A1* | 3/2015 | Chen | H04R 19/04 257/254 |
| 2016/0088402 | A1* | 3/2016 | Hu | H04R 7/20 381/174 |
| 2016/0219378 | A1* | 7/2016 | Hall | H04R 23/02 |
| 2016/0304337 | A1* | 10/2016 | Miao | B81C 1/00158 |
| 2017/0013364 | A1* | 1/2017 | Schelling | H04R 9/048 |
| 2017/0200440 | A1* | 7/2017 | Chen | G10K 11/16 |
| 2018/0027337 | A1* | 1/2018 | Hsu | H04R 17/025 257/416 |
| 2018/0262844 | A1* | 9/2018 | Barzen | B81B 3/00 |

FOREIGN PATENT DOCUMENTS

| | | |
|---|---|---|
| KR | 10-1019071 | 3/2011 |
| KR | 10-2012-0130310 | 10/2013 |
| KR | 10-1578542 | 12/2015 |

* cited by examiner

MICROPHONE AND MANUFACTURING METHOD THEREOF

CROSS-REFERENCE TO RELATED APPLICATION

This application claims priority to and the benefit of Korean Patent Application No. 10-2017-0058894 filed in the Korean Intellectual Property Office on May 11, 2017, the entire contents of which are incorporated herein by reference.

BACKGROUND

(a) Field of the Disclosure

The present disclosure relates to a microphone and a manufacturing method thereof, and more particularly, to a MEMS microphone that maintains electrostatic capacitance and prevents damage to the diaphragm.

(b) Description of the Related Art

Generally, a microelectromechanical system (MEMS) microphone is a device that converts an audio signal into an electrical signal and is manufactured using a semiconductor batch process. Compared with an electrets condenser microphone (ECM) applied to many vehicles, the MEMS microphone has improved sensitivity and reduces performance variations, has a microminiaturized sized, and improved resistance to environmental conditions (e.g., heat, humidity, and the like). Accordingly, development steps have been made toward the replacement of the ECM with the MEMS microphone.

Typically, the MEMS microphones are classified into a capacitive MEMS microphone and a piezoelectric MEMS microphone. The capacitive MEMS microphone is formed with a fixed membrane and a diaphragm. When a sound pressure is applied from the exterior to the diaphragm, a gap between the fixed membrane and the diaphragm is changed and thus, a capacitance value is changed. The sound pressure is changed into an electrical signal at this time. In the capacitive MEMS microphone, a change in capacitance between the diaphragm and the fixed membrane is measured and output as a voltage signal and it is expressed as sensitivity which is one of major performance indices.

In early MEMS microphones, the insulating layer was not disposed between the diaphragm and the fixed membrane. However, recently, MEMS microphones include structures having an insulating layer formed between the diaphragm and the fixed membrane. In the case of the capacitive MEMS microphone, an electrode may be damaged due to electrostatic force, generated when the microphone is operated. To prevent damage due to the electrostatic force, an insulating layer has been disposed between two electrodes. However, the insulating layer reduces the electrostatic capacitance and generates a charge trap phenomenon.

In particular, omission of the insulating layer between the diaphragm and the fixed membrane has the advantage of simplifying fabrication cost and process. However, a gap between the diaphragm and the fixed membrane may be reduced due to decrease of the diaphragm thickness to improve sensitivity, decrease the membrane stiffness, or reduce the size of the microphone. Accordingly, when a bias voltage greater than a pull-in voltage is applied to the microphone or an electrostatic force other than the bias voltage is generated, the diaphragm is destroyed or damaged. Therefore, a structure that resolves the electrostatic capacitance reduction, the charge trap phenomenon, and the diaphragm damage is required.

The above information disclosed in this section is merely for enhancement of understanding of the background of the invention and therefore it may contain information that does not form the prior art that is already known in this country to a person of ordinary skill in the art.

SUMMARY

The present disclosure provides a microphone and a manufacturing method thereof that may prevent damage to a diaphragm due to a bias voltage greater than a pull-in voltage or an electrostatic force in a structure of a microphone absent an insulating layer between a diaphragm and a fixed membrane to improve sensitivity.

According to an exemplary embodiment of the present disclosure a microphone may include a substrate with a cavity formed in a central portion thereof, a diaphragm disposed on the substrate to cover the cavity and having a first non-doped area formed at predetermined (e.g., consistently spaced) intervals, a fixed membrane spaced apart from the diaphragm with an air layer interposed therebetween, and having a second non-doped area that protrudes upward (e.g., in an upward direction) to prevent direct contact with the diaphragm and a supporting layer that supports the fixed membrane and the diaphragm disposed thereon.

In some exemplary embodiments, the second non-doped area may be formed at a position corresponding to the first non-doped area. The first non-doped area and the second non-doped area may be formed in a subset of an entire area of the diaphragm. In some exemplary embodiments, the first non-doped area and the second non-doped area may be resistors. The first non-doped area and the second non-doped area may abut (e.g., be in contact with each other) by a bias voltage greater than a pull-in voltage or an electrostatic force to enable a charge between the two contact surfaces to flow toward the fixed membrane. The first non-doped area and the second non-doped area may be disposed at predetermined intervals by ring-type non-doped polysilicon structures of different diameters or in a spiral shape of the polysilicon structures.

In another exemplary embodiment, the microphone may include a pad portion that electrically connects the fixed membrane or the diaphragm to a semiconductor chip and configured to measure a capacitance that corresponds to a change in a distance between the fixed membrane and the diaphragm. The diaphragm may include a vibration electrode configured to vibrate by a sound input through the cavity, the first non-doped area formed at predetermined intervals in the vibration electrode; and a slot formed around a center of the vibration electrode and penetrating a portion of a conductive line portion of the vibration electrode.

In addition, the fixed membrane may include a fixed electrode configured to sense vibration displacement of the diaphragm, the second non-doped area formed to protrude (e.g., extend) from an upper portion of the fixed electrode and sound apertures that include a plurality of apertures formed on a front surface of the fixed electrode and configured to provide the sound through the cavity into the air layer. The diaphragm may be formed at an exterior side of the substrate and the fixed membrane may be formed below the diaphragm. The fixed membrane may be formed at an exterior side of the substrate and the diaphragm may be formed below the fixed membrane.

In another exemplary embodiment of the present disclosure, the method for manufacturing the microphone may include depositing a fixed membrane on an upper portion of a substrate and forming a second non-doped area and a plurality of sound apertures. The second non-doped area may protrude at predetermined intervals on the fixed membrane. The method may further include forming a sacrificial layer and a diaphragm on an upper portion of the fixed membrane and forming a first non-doped area in the diaphragm at predetermined intervals, forming the plurality of slots by patterning a portion of an edge of the diaphragm with respect to a central portion of the diaphragm, etching a central portion of a second surface of the substrate to form a cavity for sound input and removing a central portion of the sacrificial layer through the slots to form an air layer and a supporting layer.

In some exemplary embodiments, the formation of a sacrificial layer and a diaphragm may include forming the first non-doped area at a position that corresponds to the second non-doped area. The diaphragm and the fixed membrane may be formed of at least one conductive material selected from a group consisting of a polysilicon, a metal, and a silicon nitride. In other exemplary embodiments, forming the plurality of slots may include forming a photosensitive layer on the diaphragm and exposing and developing the photosensitive layer to form a photosensitive layer pattern for forming an area cavity and forming the slots by using the photosensitive layer pattern as a mask to etch a portion of the diaphragm. The action of forming the plurality of slots may include etching the diaphragm and a portion of the sacrificial layer to form a via aperture to open a conductive line portion of the fixed membrane and patterning a first pad on the fixed membrane by the via aperture and patterning a second pad on the diaphragm.

In another aspect, a microphone may include a substrate with a cavity formed in a central portion thereof, a diaphragm covering the cavity and having a first non-doped area that protrudes at predetermined intervals, a fixed membrane spaced apart from the diaphragm with an air layer interposed therebetween, and having a second non-doped area having a predetermined interval to prevent direct contact with the diaphragm and a supporting layer that supports the fixed membrane and the diaphragm disposed thereon.

In some exemplary embodiments, the first non-doped area and the second non-doped area may be formed in ring structures and a dimple structure may be formed between the ring structures. The first non-doped area may be formed as a protruding ring structure formed by ion implantation after a process of forming a wrinkle pattern in the diaphragm. The non-doped areas may be formed between the diaphragm and the fixed membrane of the microphone that improves sensitivity by omitting the insulating layer and prevents stiction between the two electrodes. Accordingly, destruction or damage of the diaphragm may be prevented. Further, when the non-doped area of the diaphragm abuts (e.g., is in contact) with the non-doped area of the fixed membrane, the charge may be prevented from being trapped between the two contact surfaces and may be removed to the fixed membrane, thereby preventing the electrode from being damaged by the electrostatic force.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
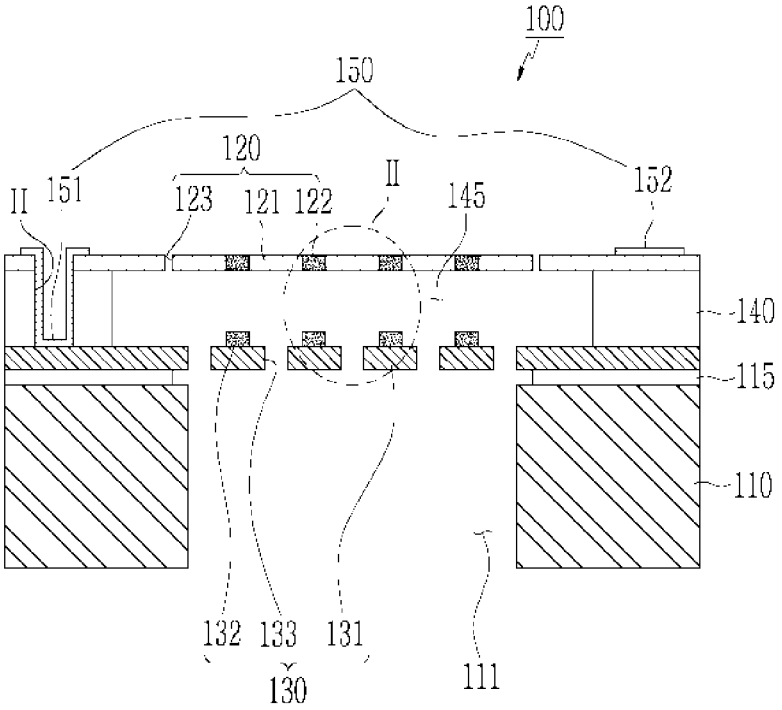
FIG. 1 is an exemplary cross-sectional view schematically showing a configuration of a microphone according to an exemplary embodiment of the present disclosure.

Hereinafter, exemplary embodiments of the present invention will be described with reference to the accompanying drawings. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other exemplary embodiments, which may be included within the spirit and scope of the invention as defined by the appended claims.

In the following detailed description, only certain exemplary embodiments of the present disclosure have been shown and described, simply by way of illustration. As those skilled in the art would realize, the described embodiments may be modified in various different ways, all without departing from the spirit or scope of the present disclosure. Accordingly, the drawings and description are to be regarded as illustrative in nature and not restrictive. Like reference numerals designate like elements throughout the specification.

The terminology used herein is for the purpose of describing particular embodiments only and is not intended to be limiting of the disclosure As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed there between.

In addition, the terms "-er", "-or" and "module" described in the specification mean units for processing at least one function and operation and can be implemented by hardware components or software components and combinations thereof.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

Although an exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

Throughout the specification, a sound source input to a microphone has the same meaning as that of a sound or a sound pressure vibrating a diaphragm. Hereinafter, a microphone and a manufacturing method thereof according to an exemplary embodiment of the present disclosure will be described in detail with reference to the accompanying drawings.

FIG. 1 is an exemplary cross-sectional view schematically showing a configuration of a microphone according to an exemplary embodiment of the present disclosure. Referring to FIG. 1, the microphone 100 may include a substrate 110, a diaphragm (e.g., a vibration membrane) 120, a fixed membrane 130, a supporting layer 140, and a pad portion 150. The substrate 110 may be formed of silicon and a cavity 111 may be formed in a central portion thereof to allow the sound (e.g., sound pressure) to be input thereto. The diaphragm 120 may be disposed at an exterior (e.g., outermost) side of the substrate 110 to cover the cavity 111. Accordingly, the diaphragm 120 may be partially exposed by the cavity 111 formed in the substrate 110 and the exposed portion may be configured to vibrate by a sound transferred from the exterior. The diaphragm 120 may be formed of a polysilicon or a silicon nitride, but, without being limited thereto, any material may be applied provided the material has conductivity.

In particular, in an exemplary embodiment, an insulating layer between the diaphragm 120 and the fixed membrane 130 may be omitted to improve sensitivity. The diaphragm 120 may have a structure for preventing the diaphragm from being damaged by a bias voltage greater than or equal to a pull-in voltage or an electrostatic force. The diaphragm 120 may include a vibration electrode 121, a first non-doped area 122, and a slot 123. A central portion of the vibration electrode 121 may be configured to vibrate by the sound input through the cavity 111. The vibration electrode 121 may be coupled to a second pad 152 that electrically connects a conductive line portion (e.g., a conductive wire portion) formed external to the cavity 111 to an external device (e.g., a semiconductor chip).

The first non-doped area 122 may be formed at predetermined (e.g., evenly spaced or consistently spaced) intervals in the diaphragm 120 and may be disposed in a circular pattern (e.g., planview). For example, the first non-doped area 122 may be arranged at predetermined intervals by ring-type non-doped polysilicon structures of different diameters or in a spiral shape (e.g., in the form of a cochlea) of the polysilicon structures.

The slot 123 may be an elongated vent aperture formed in a portion of a conductive line portion of the vibration electrode 121. For example, during a manufacturing process, a portion of a sacrificial layer 140' may be removed to form the supporting layer 140. The slots 123 may be formed in pluralities around a center of the vibration electrode 121 to reduce the air damping influence by vibration of the diaphragm 120 due to input of the external sound, and the sensitivity of the microphone may be improved.

The air damping may include absorption of the vibration of the diaphragm 120 by the air and suppression of pressure and the vibration displacement. In particular, air damping effect may include sensitivity deterioration due to suppression of the vibration displacement. The slots 123 may attenuate vibration of the diaphragm 120 by the air and may receive vibration of the diaphragm by the sound to improve sensitivity of the microphone.

The fixed membrane 130 may be disposed with an air layer 145 spaced apart from a lower portion of the diaphragm 120 to cover the cavity 111. The fixed membrane 130 may include a fixed electrode 131, a second non-doped area 132, and a sound aperture 133. The fixed electrode 131 may be configured to sense vibration displacement of the diaphragm 120 and may include a conductive line portion coupled to a first pad 151 electrically connected to an external device (e.g., a semiconductor chip).

A conductive line portion of an edge of the fixed electrode 131 may be supported and fixed by the supporting layer 140 including an oxide. The supporting layer 140 may be disposed on the conductive line portion of the fixed electrode 131 and may be formed by etching a portion of the sacrificial layer 140' in the manufacturing method of the microphone 100. The air layer 145 may be a cavity formed by etching of the sacrificial layer 140'. An oxide film 115 may be disposed between the substrate 110 and the fixed electrode 131 and a center portion of the oxide film 115 may be opened or etched to extend the cavity 111 inward.

The second non-doped area 132 may be formed to protrude (e.g., extend) from an upper portion of the fixed electrode 131 and may prevent the fixed electrode 131 from directly being in contact with the vibration electrode 121. The second non-doped area 132 may be formed at a position that corresponds to the first non-doped area 122. The sound apertures 133 may be a plurality of apertures formed on a front surface of the fixed electrode 131 and may be configured to provide the sound through the cavity 111 to the air layer 145.

The pad portion 150 may be formed of a metal pad that electrically connects each electrode to the semiconductor chip and may be configured to measure a capacitance that corresponds to a change in a distance between the fixed membrane 130 and the diaphragm 120. The pad portion 150 may include the first pad 151 patterned on a conductive line portion of the fixed electrode 131 through a via aperture H and the second pad 152 patterned on a conductive line portion of the vibration electrode 121.

The microphone 100 may have a structure with an insulating layer omitted between the diaphragm 120 and the fixed membrane 130 to improve sensitivity. However, in the structure with the insulating layer omitted, a gap between the diaphragm 120 and the fixed membrane 130 may be reduced due to a reduced size of the microphone. In addition, stiction may occur when a bias voltage greater than or equal to a pull-in voltage is applied to the microphone or electrode damage due to an electrostatic force other than the bias voltage may occur. Accordingly, to resolve the above mentioned concerns, the microphone 100 may include non-doped areas 122 and 132 configured to prevent direct contact between the electrode of the diaphragm 120 and the electrode of the fixed membrane 130.

Figure 2A:
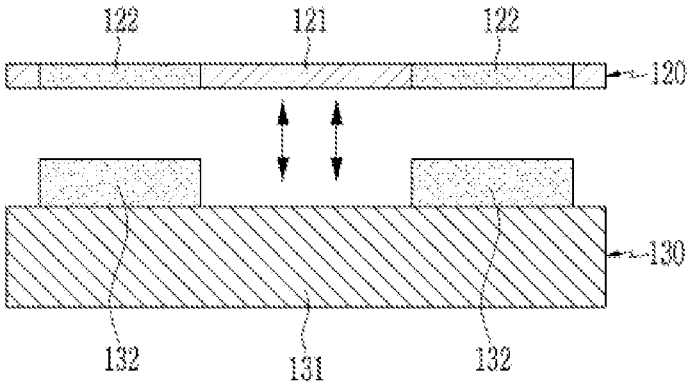
FIG. 2A is an exemplary enlarged cross-sectional view showing a normal distance maintaining state between a diaphragm and a fixed membrane according to an exemplary embodiment of the present disclosure.
Figure 2B:
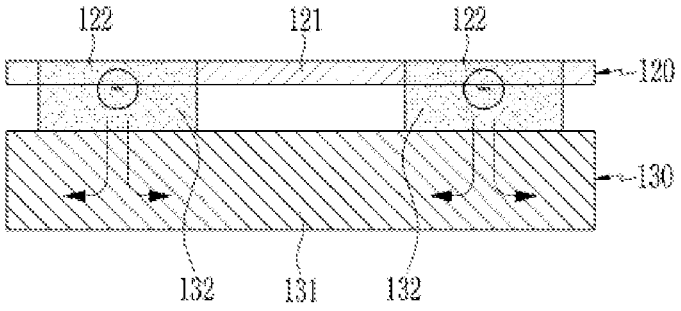
FIG. 2B is an exemplary enlarged cross-sectional view showing a stiction occurrence state between a diaphragm and a fixed membrane according to an exemplary embodiment of the present disclosure.
Figure 3:
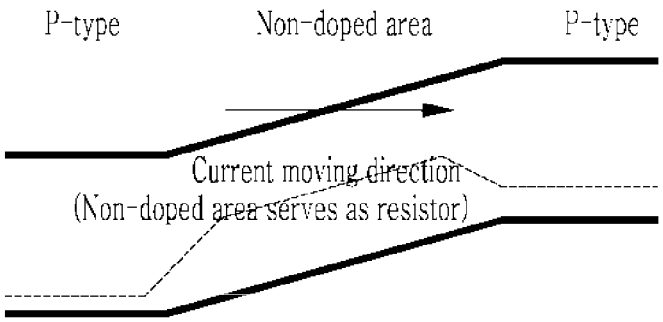
FIG. 3 shows an exemplary energy band diagram of the diaphragm and the fixed membrane that abut each other according to an exemplary embodiment of the present disclosure.
Figure 4:
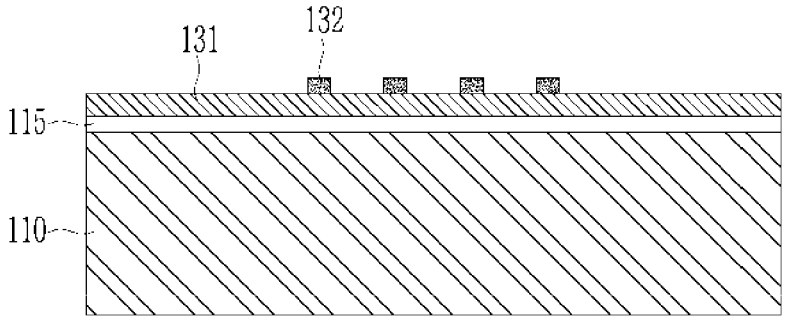
FIG. 4 to FIG. 10 are an exemplary sequence of a method of manufacturing a microphone according to an exemplary embodiment of the present disclosure.

FIG. 2A is an exemplary enlarged cross-sectional view showing a normal distance maintaining state between the diaphragm and the fixed membrane according to an exemplary embodiment of the present disclosure. FIG. 2B is an exemplary enlarged cross-sectional view showing a stiction occurrence state between the diaphragm and the fixed membrane according to an exemplary embodiment of the present disclosure. FIG. 3 shows an exemplary energy band diagram of the diaphragm and the fixed membrane in contact with each other according to an exemplary embodiment of the present disclosure. Referring to FIGS. 2A, 2B and 3, the microphone 100 may include the first non-doped area 122 formed at predetermined intervals in the vibration electrode 121 of the diaphragm 120. Further, the microphone 100 may include the second non-doped area 132 formed on the fixed electrode 131 of the fixed membrane 130 facing the diaphragm 120.

Referring to FIG. 2A, when the diaphragm 120 and the fixed membrane 130 maintain a normal distance and the sound is input, the diaphragm 120 may be configured to vibrate and may be displaced in a vertical orientation (e.g., move up and down). In a conventional microphone structure, when the bias voltage greater than or equal to the pull-in voltage is applied to the microphone, the stiction occurs when the electrode of the diaphragm and the electrode of the fixed membrane are directly in contact with each other. When the stiction is maintained, vibration of the diaphragm due to the sound is not detected.

The microphone 100 may utilize the protruding second non-doped area 132 to prevent the vibration electrode 121 and the fixed electrode 131 from being in direct contact with each other when the bias voltage greater than or equal to the pull-in voltage is applied to the microphone. The first non-doped area 122 and the second non-doped area 132 may be formed at positions that correspond to each other and may be formed in a subset of an entire area (e.g., a small area) with respect to the entire area of the diaphragm 120 within a range of about 1 to 5 μm (dia.).

In addition, the non-doped areas 122 and 132 may be resistors having a predetermined resistance value (e.g., about 1 MΩ). As shown in FIG. 2B, when the bias voltage greater than or equal to the pull-in voltage is applied to the microphone 100, the first non-doped area 122 and the second non-doped area 132 may be in contact with each other. However, electrons may be transmitted to the fixed membrane 130 without being captured between the two contact surfaces. In particular, the first non-doped area 122 and the second non-doped area 132 may abut (e.g., be in contact with each other) by the bias voltage greater than or equal to the pull-in voltage or the electrostatic force to enable the charge between the two contact surfaces to flow toward the fixed membrane 130. When the bias voltage becomes less than the pull-in voltage, the diaphragm 120 may be restored to an original position.

The method of manufacturing the microphone according to an exemplary embodiment of the present disclosure will be described with reference to the drawings based on the structure of the microphone 100 described above. However, in the following description, the fixed electrode 131 and the vibration electrode 121 may be used to refer to the fixed membrane 130 and the diaphragm 120.

FIG. 4 to FIG. 10 are an exemplary sequential illustration that show the method of manufacturing the microphone according to an exemplary embodiment of the present disclosure. First, referring to FIG. 4, the oxide film 115 may be formed on the substrate 110 after the substrate 110 is prepared. The substrate 110 may be formed of silicon, and the oxide film 115 may be formed by depositing silicon oxide.

Further, a process of forming the fixed membrane 130 including the fixed electrode 131, the second non-doped area 132, and the sound aperture 133 on the oxide film 115 will be described. The fixed electrode 131 may be deposited on the oxide film 115 and the second non-doped area 132 may be formed by patterning a non-doped polysilicon on the fixed electrode 131 at predetermined intervals. The fixed electrode 131 may be formed of a polysilicon, a metal, or silicon nitride (SiNx), but is not limited thereto. The fixed electrode 131 may be formed of a conductive material that is used as an electrode.

Figure 5:
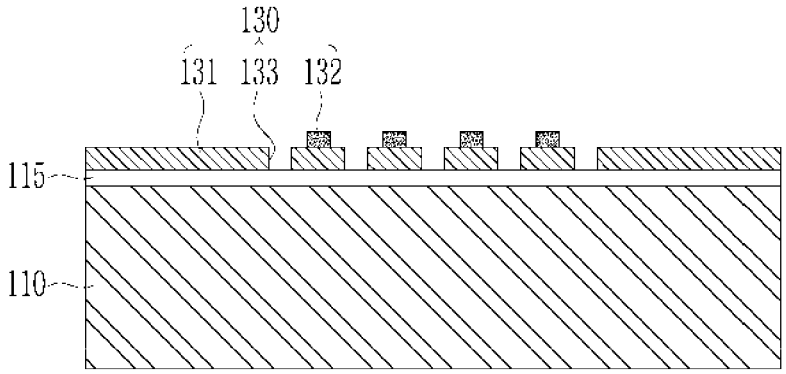

Referring to FIG. 5, the fixed electrode 131 may be etched to form the plurality of sound apertures 133 penetrating the fixed electrode with a similar (e.g., the same) pattern. The plurality of sound apertures 133 may be formed by performing dry etching or wet etching, and the dry etching or the wet etching may be performed until the oxide film 115 is exposed.

Figure 6:
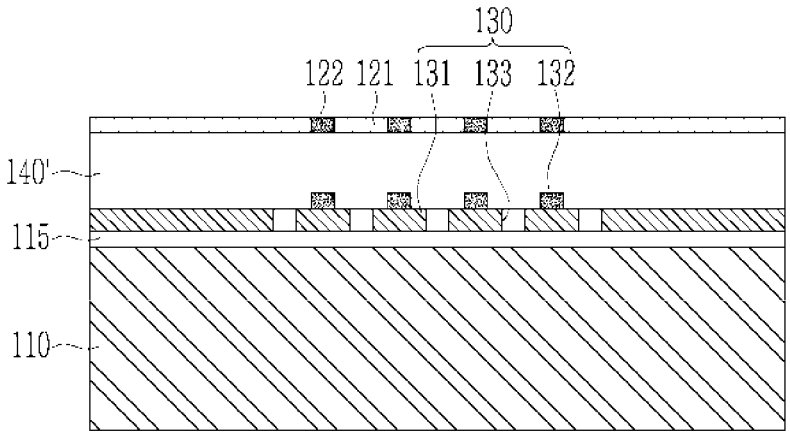

Referring to FIG. 6, the sacrificial layer 140' may be formed on the fixed membrane 130. Further, a process of forming the diaphragm 120 including the vibration electrode 121, the first non-doped area 122, and the slot 123 on the sacrificial layer 140' will be described. The vibration electrode 121 may be deposited on the sacrificial layer 140', and the first non-doped area 122 may be formed in the vibration electrodes 121 at predetermined (e.g., consistently spaced) intervals. The first non-doped area 122 may be formed at a position that corresponds to the second non-doped area 132. The vibration electrode 121 may be formed from a polysilicon, a metal, or a silicon nitride film in the same manner as the fixed electrode 131, but is not limited thereto. The vibration electrode 121 may be formed of a conductive material usable as an electrode.

Figure 7:
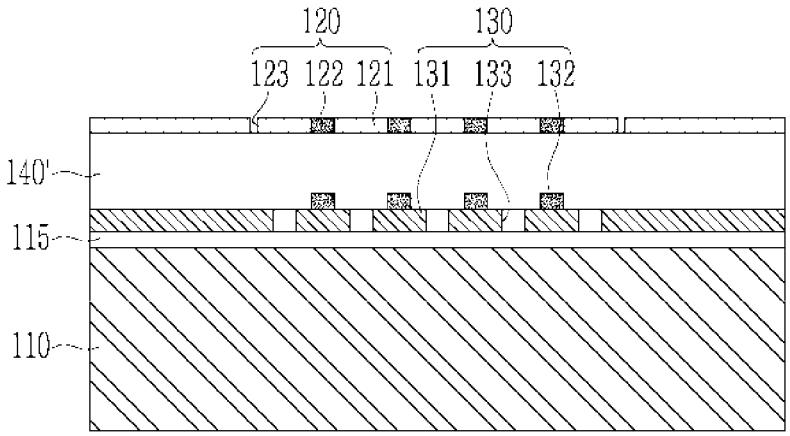

Referring to FIG. 7, the plurality of slots 123 may be formed by patterning a portion of an edge of the vibration electrode 121 with respect to the central axis of the vibration electrode. The slot 123 may be formed by disposing a photosensitive layer on the vibration electrode 121, exposing and developing the photosensitive layer to form a photosensitive layer pattern for forming a cavity and using the photosensitive layer pattern as a mask to etch a portion of the vibration electrode 121.

Figure 8:
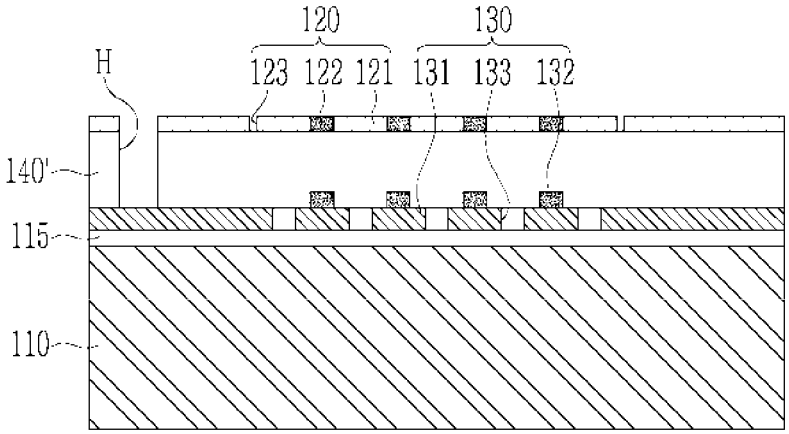

Referring to FIG. 8, after the diaphragm 120 is formed as described above, the vibration electrode 121 and a part of the sacrificial layer 140' may be etched to form the via aperture H having an open top. The via aperture H may be formed by etching the vibrating electrode 121 and the sacrificial layer 140' until the conductive line portion of the fixed electrode 131 is exposed.

Figure 9:
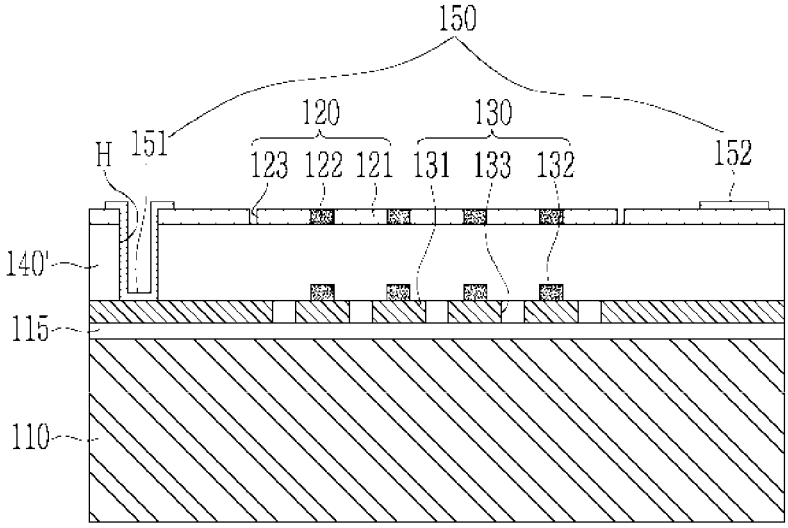

Referring to FIG. 9, the first pad 151 may be patterned on the fixed membrane 130 via the via aperture H, and the second pad 152 may be patterned on the diaphragm 120. The fixed electrode 131 and the vibration electrode 121 may be electrically connected to an external signal processing component through the first pad 151 and the second pad 152, respectively.

Figure 10:
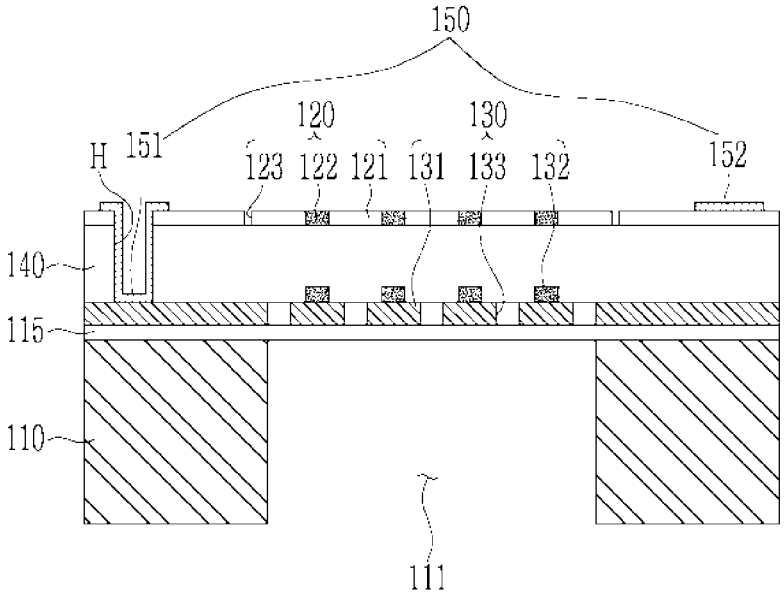

Referring to FIG. 10, a central portion of a second (e.g., back) surface of the substrate 110 may be etched to form the cavity 111 for sound input. The oxide film 115 in a region of the cavity 111 of the substrate 110 may be removed and a central portion of the sacrificial layer 140' may be removed to form the microphone 100.

Referring to FIG. 1, the removed region of the sacrificial layer 140' may form the air layer 145 and an unremoved edge portion of the sacrificial layer 140' may form the supporting layer 140 that supports an edge of the diaphragm 120. The air layer 145 may be formed by removing the sacrificial layer 140' by a wet method using an etching solution through the slot 123 of the diaphragm 120. In another exemplary embodiment of the present disclosure, the sacrificial layer 140' may be removed by a dry method when ashing is performed using $O_2$ plasma through the slot 123.

As described above, according to the exemplary embodiment of the present disclosure, the non-doped areas may be formed between the diaphragm and the fixed membrane of the microphone to omit the insulating layer for improving sensitivity, thereby preventing occurrence of the stiction between the two electrodes. Thus, destruction or damage of the diaphragm may be prevented. Additionally, when the non-doped area of the diaphragm abuts (e.g., is in contact with) the non-doped area of the fixed membrane, the charge may be transmitted (e.g., may not be trapped between the two contact surfaces and may escape) to the fixed membrane, thereby preventing the electrode from being damaged by the electrostatic force.

While the present disclosure has been described with reference to the exemplary embodiment, it is to be understood that the disclosure is not limited to the disclosed exemplary embodiment and various other modifications of the disclosure are possible. The other modifications of the disclosure will be described with reference to FIGS. 11 to 13.

Figure 11:
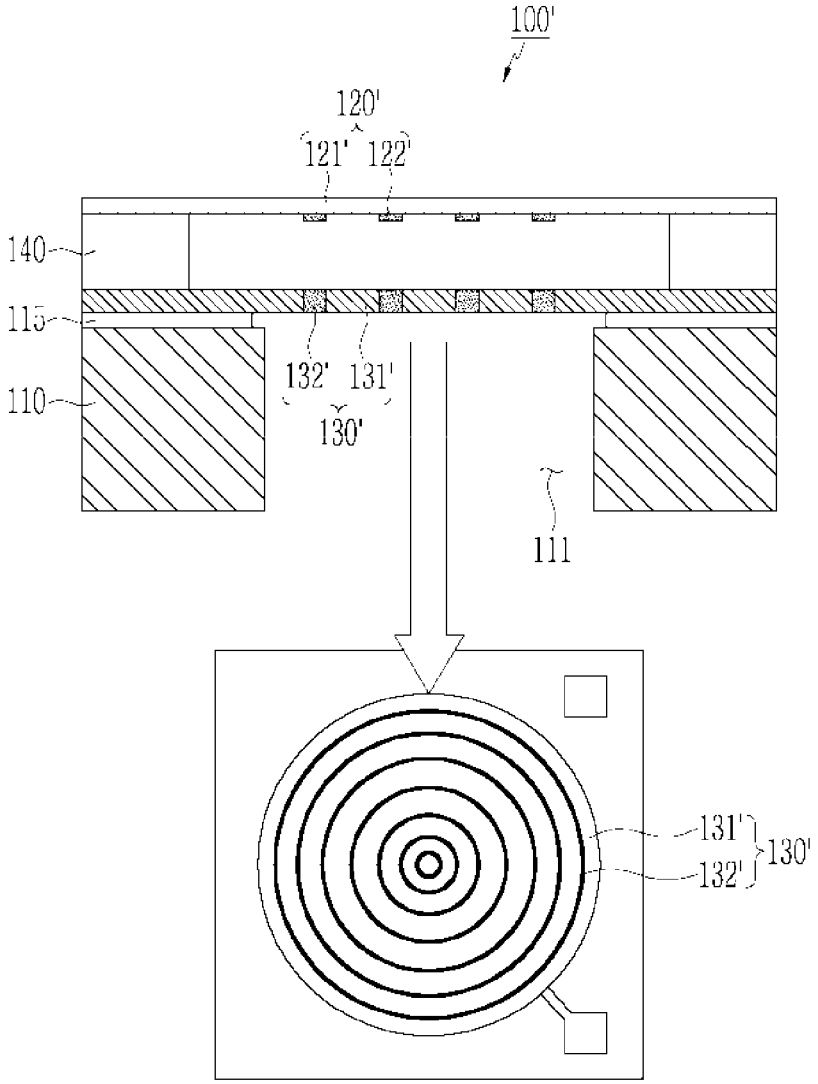
FIG. 11 is an exemplary cross-sectional view schematically showing a configuration of a microphone according to a first modified exemplary embodiment of the present disclosure.

FIG. 11 is an exemplary cross-sectional view schematically showing a configuration of a microphone according to a first modified exemplary embodiment of the present disclosure. Referring to FIG. 11, the microphone 100' according to the first modified exemplary embodiment of the present disclosure may be similar to the configuration of FIG. 1. Thus, overlapping descriptions will be omitted and a modified non-doped area will be mainly described. A diaphragm 120' may include a first non-doped area 122' formed of a protruding non-doped polysilicon at predetermined intervals disposed under a vibration electrode 121'. The first non-doped area 122' may include protruding rings having different diameters.

As shown in exemplary plan view of FIG. 11, a fixed membrane 130' may form a second non-doped area 132' formed in a fixed electrode 131' with a predetermined interval of a non-doped polysilicon pattern. The first non-doped area 122' and the second non-doped area 132' may be formed at positions that correspond to each other to prevent direct contact between facing electrodes. Accordingly, stiction may be prevented when the bias voltage greater than or equal to than the pull-in voltage is applied. An additional dimple structure may be formed between ring structures of the first non-doped area 122' and the second non-doped area 132', which may prevent the stiction and reduce the contact impact.

Figure 12:
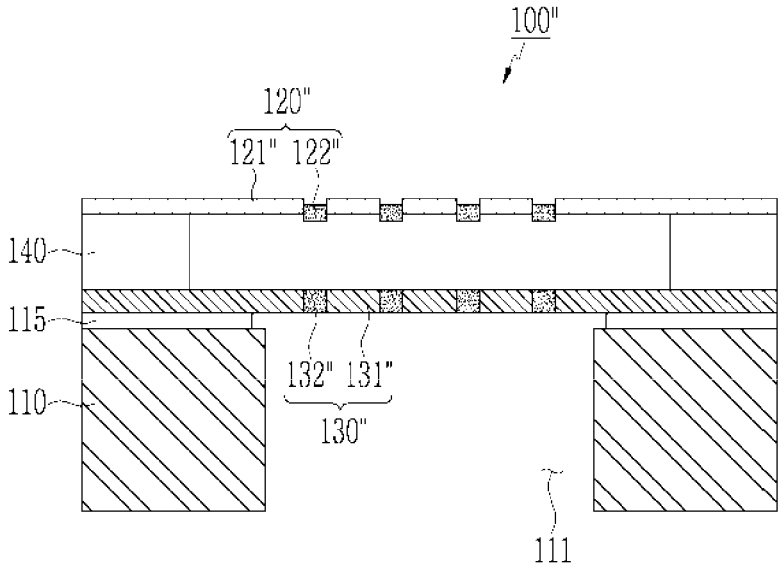
FIG. 12 is an exemplary cross-sectional view schematically showing a configuration of a microphone according to a second modified exemplary embodiment of the present disclosure.

FIG. 12 is an exemplary cross-sectional view schematically showing a configuration of a microphone according to a second modified exemplary embodiment of the present disclosure. Referring to FIG. 12, a diaphragm 120" of the microphone 100" according to the second modified exemplary embodiment of the present disclosure may include a vibration electrode 121" and a first non-doped area 121" of ring shape generated by ion implantation after forming a wrinkle pattern in the vibration electrode. A fixed membrane 130" may form a second non-doped area 132" formed in a fixed electrode 131" with a predetermined interval of a non-doped polysilicon pattern.

When the first non-doped area 122" has a structure having a portion of the first non-doped area that protrudes downward in a wrinkle form, the stiction between the two electrodes may be prevented when the first non-doped area is in contact with the second non-doped area 132". When the first non-doped area 122" is formed in the wrinkle form, stress of the diaphragm 120" may be reduced. Thus, sensitivity of the microphone may be improved by increasing vibration displacement.

Figure 13:
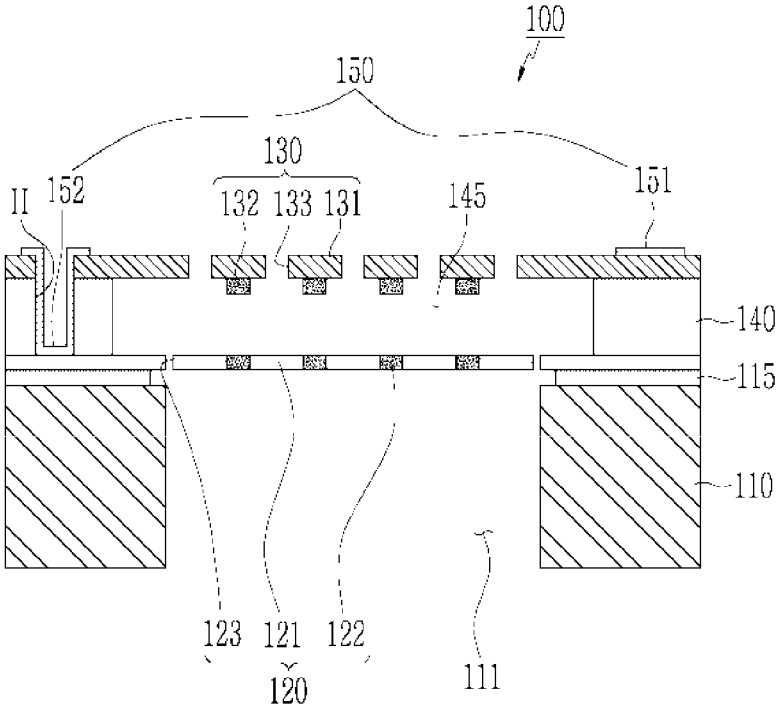
FIG. 13 is an exemplary cross-sectional view schematically showing a configuration of a microphone according to a third modified exemplary embodiment of the present disclosure.

FIG. 13 is an exemplary cross-sectional view schematically showing a configuration of a microphone according to a third modified exemplary embodiment of the present disclosure. Referring to FIG. 13, the microphone 100 according to the third modified exemplary embodiment may be different from the microphone of FIG. 1 by including positions of the diaphragm 120 and the fixed membrane 130 that are different from each other. As shown in FIG. 1, the exemplary embodiment may form the diaphragm 120 at an exterior (e.g., outermost) side and may form the fixed membrane 130 disposed below the diaphragm, but the present disclosure is not limited thereto. In other words, as shown in FIG. 13, the microphone 100 may form the fixed membrane 130 at an exterior side and may form the diaphragm 120 disposed below the fixed membrane.

While this disclosure has been described in connection with what is presently considered to be exemplary embodiments, it is to be understood that the disclosure is not limited to the disclosed exemplary embodiments, but, on the contrary, is intended to cover various modifications and equivalent arrangements included within the spirit and scope of the appended claims.

DESCRIPTION OF SYMBOLS

100: microphone
110: substrate
111: cavity
120: diaphragm
121: vibration electrode
122: first non-doped area
123: slot
130: fixed membrane
131: fixed electrode
132: second non-doped area
133: sound aperture

140: supporting layer
140': sacrificial layer
145: air layer
150: pad portion

What is claimed is:

1. A microphone, comprising:

a substrate with a cavity formed in a central portion thereof;

a diaphragm disposed on the substrate to cover the cavity and having a first non-doped area formed at predetermined intervals;

a fixed membrane spaced apart from the diaphragm with an air layer interposed therebetween, and having a second non-doped area that protrudes upward to separate the fixed membrane and the diaphragm; and a supporting layer that supports the fixed membrane and the diaphragm, wherein the first non-doped area and the second non-doped area are resistors, and wherein the first non-doped area and the second non-doped area abut each other by a bias voltage greater than or equal to a pull-in voltage or an electrostatic force with the two contact surfaces having a charge therebetween that flows toward the fixed membrane.

2. The microphone of claim 1, wherein the second non-doped area is formed at a position that corresponds to the first non-doped area.

3. The microphone of claim 1, wherein the first non-doped area and the second non-doped area are formed in a subset area with respect to an entire area of the diaphragm.

4. The microphone of claim 1, wherein the first non-doped area and the second non-doped area are disposed at predetermined intervals by ring-type non-doped polysilicon structures of different diameters or in a spiral shape of the polysilicon structures.

5. The microphone of claim 1, further comprising:

a pad portion that electrically connects the fixed membrane or the diaphragm to a semiconductor chip to measure a capacitance that corresponds to a change in a distance between the fixed membrane and the diaphragm.

6. The microphone of claim 1, wherein the diaphragm includes:

a vibration electrode configured to vibrate by a sound input through the cavity, wherein the first non-doped area is formed at predetermined intervals in the vibration electrode, and wherein a slot is formed around a center of the vibration electrode and penetrates a portion of a conductive line portion of the vibration electrode.

7. The microphone of claim 1, wherein the fixed membrane includes:

a fixed electrode configured to sense vibration displacement of the diaphragm, wherein the second non-doped area protrudes from an upper portion of the fixed electrode, and wherein sound apertures are on a front surface of the fixed electrode and provide the sound through the cavity into the air layer.

8. The microphone of claim 1, wherein the diaphragm is formed at an exterior side of the substrate and the fixed membrane is formed below the diaphragm.

9. The microphone of claim 1, wherein the fixed membrane is formed at an exterior side of the substrate, and the diaphragm is formed below the fixed membrane.

10. A method for manufacturing a microphone, comprising:

depositing a fixed membrane on an upper portion of a substrate and forming a second non-doped area and a plurality of sound apertures, wherein the second non-doped area protrudes at predetermined intervals on the fixed membrane;

forming a sacrificial layer and a diaphragm on an upper portion of the fixed membrane and forming a first non-doped area in the diaphragm at predetermined intervals;

forming the plurality of slots by patterning a portion of an edge of the diaphragm with respect to a central portion of the diaphragm;

etching a central portion of a second surface of the substrate to form a cavity for sound input; and removing a central portion of the sacrificial layer through the slots to form an air layer and a supporting layer;

wherein forming the plurality of slots includes:

etching the diaphragm and a portion of the sacrificial layer to form a via aperture that opens a conductive line portion of the fixed membrane; and patterning a first pad on the fixed membrane via the via aperture and patterning a second pad on the diaphragm.

11. The method of claim 10, wherein forming the sacrificial layer and the diaphragm includes forming the first non-doped area at a position that corresponds to the second non-doped area.

12. The method of claim 10, wherein the diaphragm and the fixed membrane are formed of at least one conductive material selected from a group consisting of a polysilicon, a metal, and a silicon nitride.

13. The method of claim 10, wherein forming the plurality of slots includes:

forming a photosensitive layer on the diaphragm and exposing and developing the photosensitive layer to form a photosensitive layer pattern for forming a through area; and forming the slots using the photosensitive layer pattern as a mask to etch a portion of the diaphragm.

14. A microphone, comprising:

a substrate with a cavity formed in a central portion thereof;

a diaphragm that covers the cavity and includes a first non-doped area that protrudes at predetermined intervals;

a fixed membrane spaced apart from the diaphragm with an air layer interposed therebetween and having a second non-doped area having a predetermined interval to prevent direct contact with the diaphragm; and a supporting layer that supports the fixed membrane and the diaphragm disposed thereon, wherein the first non-doped area is a protruding ring structure formed by ion implantation after forming a wrinkle pattern in the diaphragm.

15. The microphone of claim 14, wherein the first non-doped area and the second non-doped area are formed in ring structures and a dimple structure is formed between the ring structures.

* * * * *